US011404818B1

(12) United States Patent
Batty et al.

(10) Patent No.: US 11,404,818 B1
(45) Date of Patent: Aug. 2, 2022

(54) WEDGE CONNECTOR ASSEMBLY WITH SEQUENTIAL SHEAR BOLTS

(71) Applicant: Buckingham Manufacturing Company, Inc., Binghamton, NY (US)

(72) Inventors: Timothy Batty, Binghamton, NY (US); Douglas Metcalfe, Arlington, WA (US)

(73) Assignee: Buckingham Manufacturing Company, Inc., Binghamton, NY (US)

( * ) Notice: Subject to any disclaimer, the term of this patent is extended or adjusted under 35 U.S.C. 154(b) by 0 days.

(21) Appl. No.: 17/132,939

(22) Filed: Dec. 23, 2020

Related U.S. Application Data

(60) Provisional application No. 62/953,757, filed on Dec. 26, 2019.

(51) Int. Cl.
*H01R 4/50* (2006.01)
*H01R 13/621* (2006.01)
*H01R 13/512* (2006.01)

(52) U.S. Cl.
CPC ..... *H01R 13/6215* (2013.01); *H01R 4/5091* (2013.01); *H01R 13/512* (2013.01)

(58) Field of Classification Search
None
See application file for complete search history.

(56) References Cited

U.S. PATENT DOCUMENTS

| | | | | | |
|---|---|---|---|---|---|
| 4,279,461 | A * | 7/1981 | Bussen | H01R 4/5083 | 439/781 |
| 4,813,894 | A * | 3/1989 | Mixon, Jr. | H01R 4/5083 | 439/783 |
| 4,915,653 | A * | 4/1990 | Mair | H01R 4/44 | 439/781 |
| 5,092,797 | A * | 3/1992 | Cole | H01R 4/5091 | 411/2 |
| D538,621 | S * | 3/2007 | Van Es | D8/72 | |
| 10,465,732 | B2 * | 11/2019 | Polidori | F16B 31/021 | |
| 10,680,353 | B2 * | 6/2020 | Murugiah | H01R 4/5091 | |

* cited by examiner

*Primary Examiner* — Felix O Figueroa
(74) *Attorney, Agent, or Firm* — Frederick J.M. Price; George R. McGuire; Bond Schoeneck & King, PLLC

(57) ABSTRACT

An electrical connector assembly, including a bolt having a tapered distal end; a wedge having a top surface and a bottom surface defining a first aperture extending between and through the top and bottom surfaces, and dimensioned to receive the bolt therethrough; a shell having a top surface, a bottom surface, a first end, and a second end, the shell further defining a first and a second channels, the channels being separated by a middle portion and to receive the wedge therebetween; the shell further having a second aperture extending between the top surface to the bottom surface of the shell and dimensioned to receive the bolt therethrough, wherein the second aperture is configured to be positioned to align and pair with the first aperture when the wedge is positioned between the first and second channels.

24 Claims, 26 Drawing Sheets

WEDGE CONNECTOR ASSEMBLY WITH SEQUENTIAL SHEAR BOLTS

REFERENCE TO RELATED APPLICATIONS

This application claims priority to U.S. Provisional Patent Application Ser. No. 62/953,757, filed on Dec. 26, 2019 and entitled "WEDGE CONNECTOR WITH SEQUENTIAL SHEAR BOLTS the entirety of which is incorporated here in.

BACKGROUND

This disclosure relates generally to electrical conductor connectors, and more specifically to a wedge connector assembly with sequential shear bolts.

In powerline maintenance and construction there is frequently a need for the connection of two electrical conductors such as conductive wires. Conventional connectors such as parallel groove connectors do not provide enough surface contact with conductors and have low conductivity.

Wedge connectors or similar connectors are commonly used to connect two conductors. Most conventional wedge connectors are installed using expensive tools and complicated methods such as fired-on tools that use explosive cartridges. This makes most conventional connectors time consuming and cumbersome to install. Therefore, there is a need for an easier to install connector with high conductivity.

Description of the Related Art Section Disclaimer: To the extent that specific patents/publications/products are discussed above in this Description of the Related Art Section or elsewhere in this disclosure, these discussions should not be taken as an admission that the discussed patents/publications/products are prior art for patent law purposes. For example, some or all of the discussed patents/publications/products may not be sufficiently early in time, may not reflect subject matter developed early enough in time and/or may not be sufficiently enabling so as to amount to prior art for patent law purposes. To the extent that specific patents/publications/products are discussed above in this Description of the Related Art Section and/or throughout the application, the descriptions/disclosures of which are all hereby incorporated by reference into this document in their respective entirety(ies).

SUMMARY

To solve the above-mentioned problems, one embodiment of the present invention is directed to a wedge connector assembly with sequential shear bolts having a wedge component that is able to form a strong and secure attachment with a shell component while being installed easily and quickly without any special tools. The wedge connector assembly of an embodiment can provide a high conductivity connection without damage to the conductors being joined, as well as the ability to easily remove the connector if desired. The easier installation method allows the assembly to be safely configured and installed when working on electrical conductors that are energized, using readily available tools that are already on the market and already being used by electrical line workers. Additionally, installation time and effort are considerably more efficient than with conventional connectors.

In accordance with an embodiment, the wedge connector assembly can use sequential shear bolts (as discussed and illustrated herein) to secure conductors and a wedge within a shell. The shear bolts can be tightened using standard tools in sequential order to further place the wedge into the shell. In one embodiment. a tapered distal head portion of at least one shear bolt (of preferably a plurality of sheer bolts) allows the shear bolt to squeeze the wedge further into the shell (the tapered or conical end provides a ramp effect for the thrusting action of the wedge towards securement), increasing contact strength with the conductors and securing the wedge and shell together (multiple functionality). The aspect of the bolts having a tapered end portion and the connector having more than one opening for more than one bolt can create a safer and more ergonomically correct way to secure the connector while creating a mechanical advantage. The safety of the assembly is enhanced via the placement of the shear bolts through each of the wedge and shell portions at an angle to each the planes of the top surfaces of the wedge and shell portions. More preferably, the shear bolts are positioned substantially perpendicularly (most preferably, perpendicularly) with respect to each the planes of the top surfaces of the wedge and shell portions. As should be understood by a person of ordinary skill in the art in conjunction with a review of this disclosure, such angled positioning of the sheer bolts provides the assembler with more room (as compared with conventional devices) to fully assemble the assembly in the field while lessening the likelihood of electrocution.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

The accompanying drawings are included to provide a further understanding of the invention, and are incorporated in and constitute a part of this specification. The drawings illustrate various embodiments of the invention and together with the description serve to explain the principles and operation of the invention.

BRIEF DESCRIPTION OF FIGURES

Embodiments of the present invention will be more fully understood and appreciated by reading the following Detailed Description in conjunction with the accompanying drawings, in which.

DESCRIPTION

Aspects of the present invention and certain features, advantages, and details thereof, are explained more fully below with reference to the non-limiting examples illustrated in the accompanying drawings. Descriptions of well-known structures are omitted so as not to unnecessarily obscure the invention in detail. It should be understood, however, that the detailed description and the specific non-limiting examples, while indicating aspects of the invention, are given by way of illustration only, and are not by way of limitation. Various substitutions, modifications, additions, and/or arrangements, within the spirit and/or scope of the underlying inventive concepts will be apparent to those skilled in the art from this disclosure.

Figure 1:
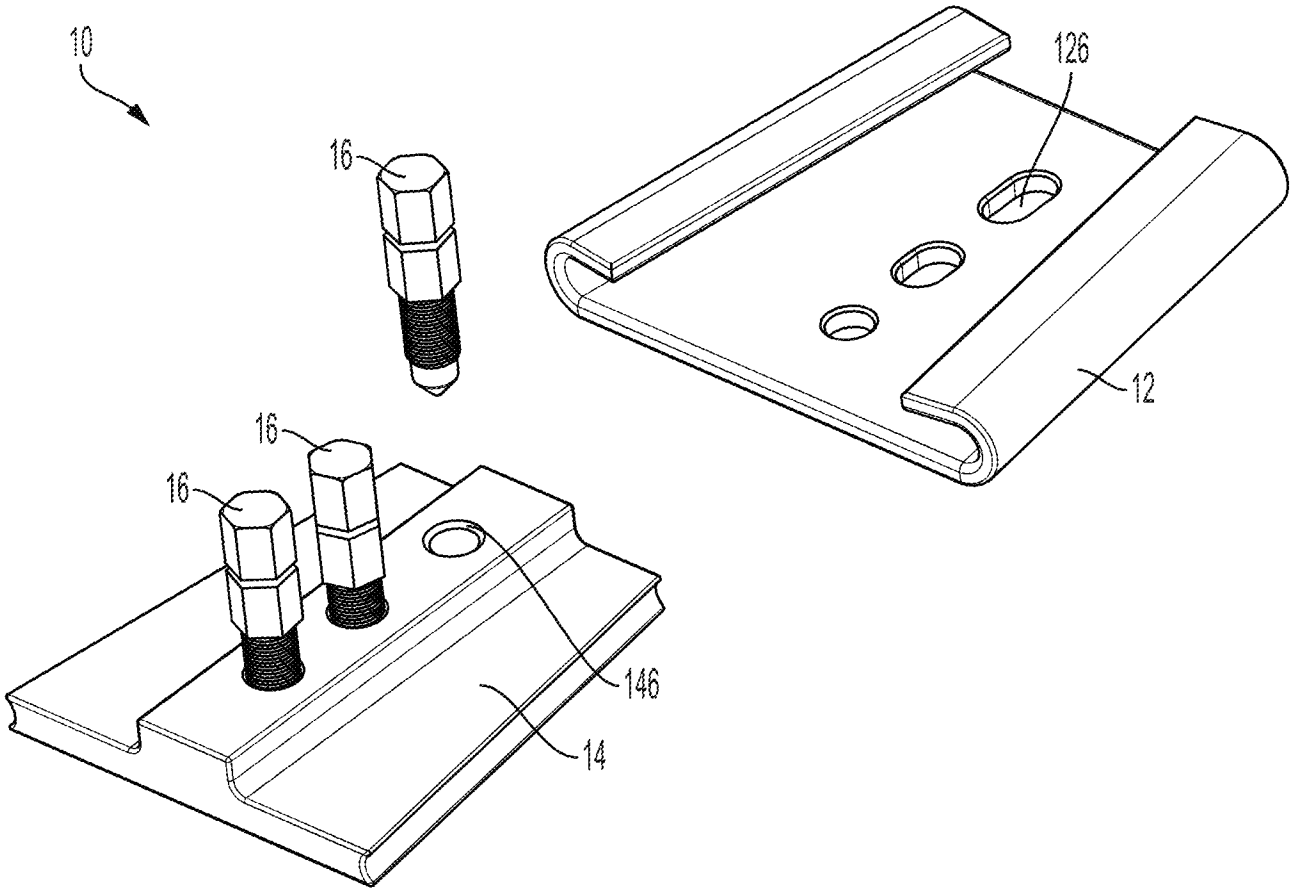
FIG. 1 is a perspective view of a wedge connector assembly with sequential shear bolts according to an embodiment.
Figure 2:
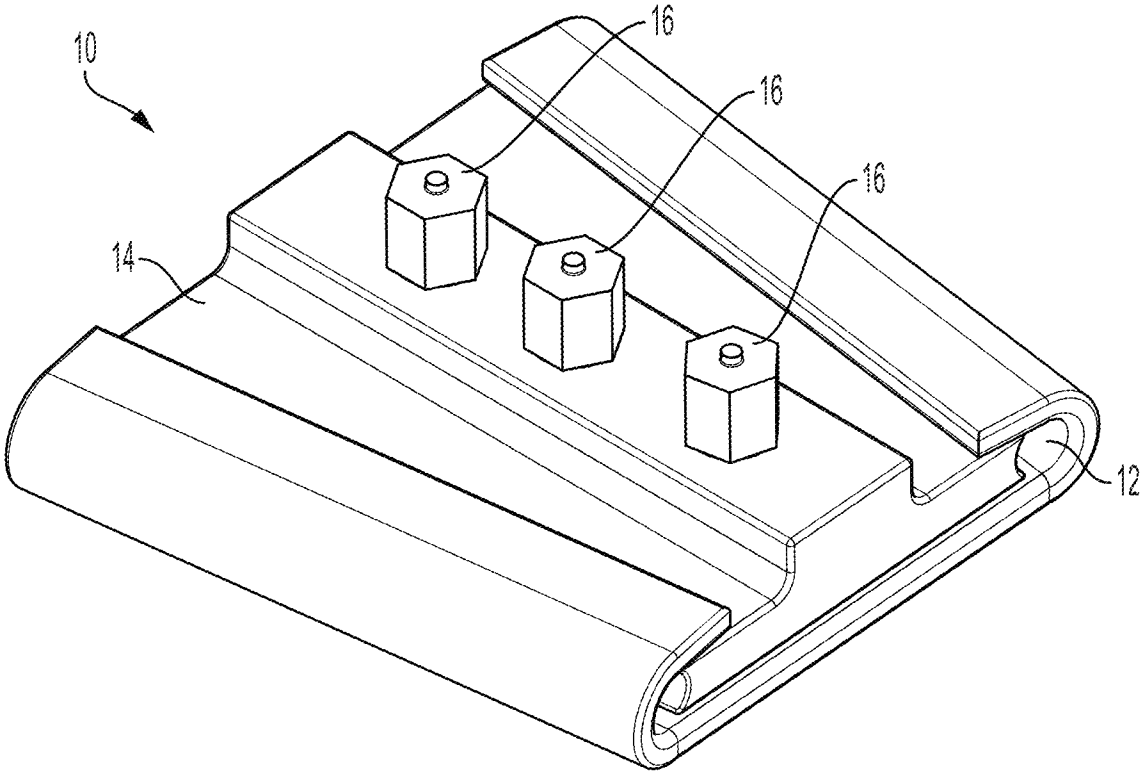
FIG. 2 is a perspective view of a wedge connector assembly with sequential shear bolts according to an embodiment.
Figure 3D:
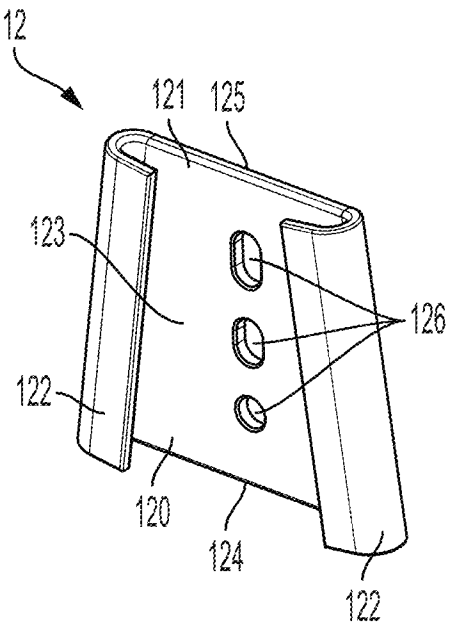
FIG. 3D is a perspective view of a shell according to an embodiment.
Figure 3C:
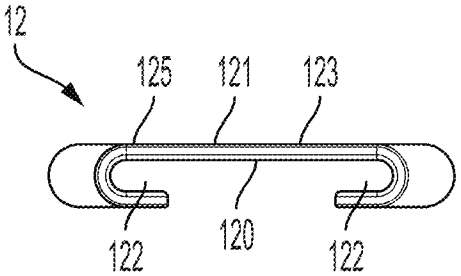
FIG. 3C is a side view of a shell according to an embodiment.
Figure 3B:
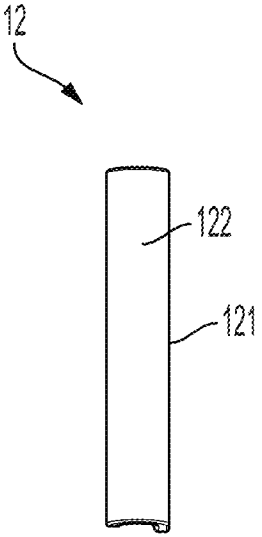
FIG. 3B is a left view of a shell according to an embodiment.
Figure 3A:
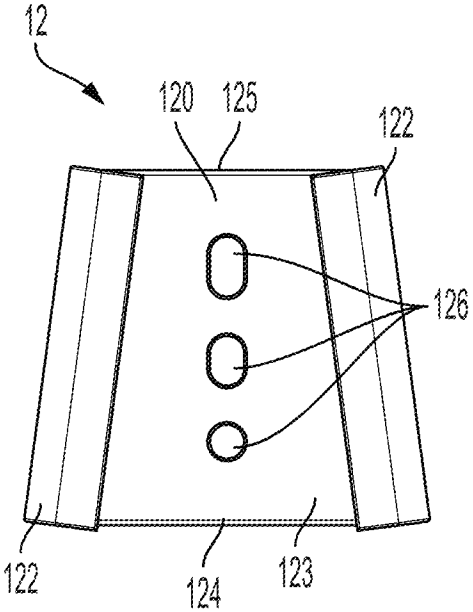
FIG. 3A is a top view of a shell according to an embodiment.
Figure 4B:
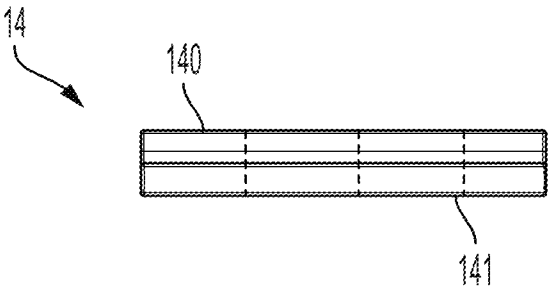
FIG. 4B is a left view of a wedge according to an embodiment.
Figure 4A:
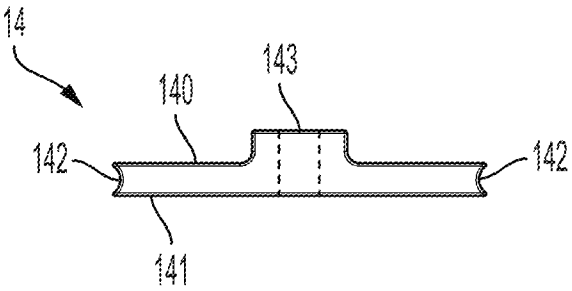
FIG. 4A is a top view of a wedge according to an embodiment.
Figure 4D:
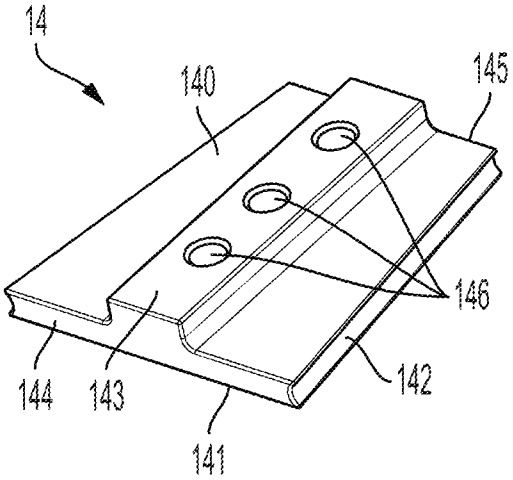
FIG. 4D is a perspective view of a wedge according to an embodiment.
Figure 4C:
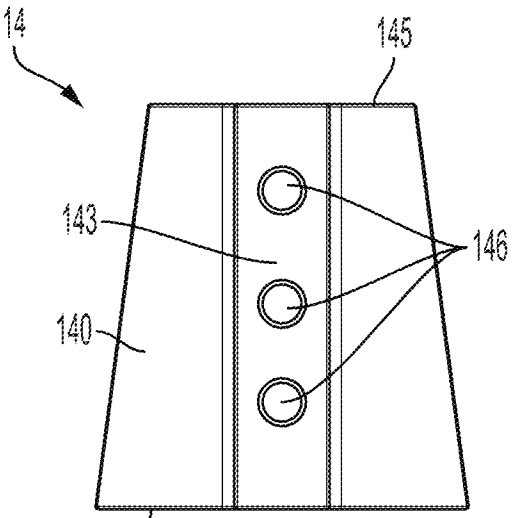
FIG. 4C is a side view of a wedge according to an embodiment.
Figure 5D:
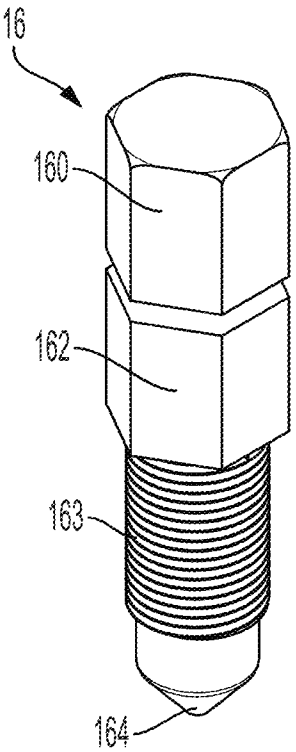
FIG. 5D is a perspective view of a shear bolt according to an embodiment.
Figure 5C:
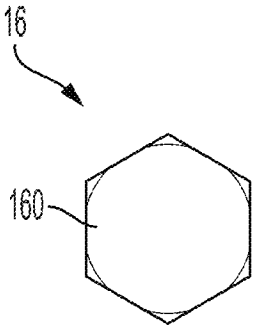
FIG. 5C is a side view of a shear bolt according to an embodiment.
Figure 5B:
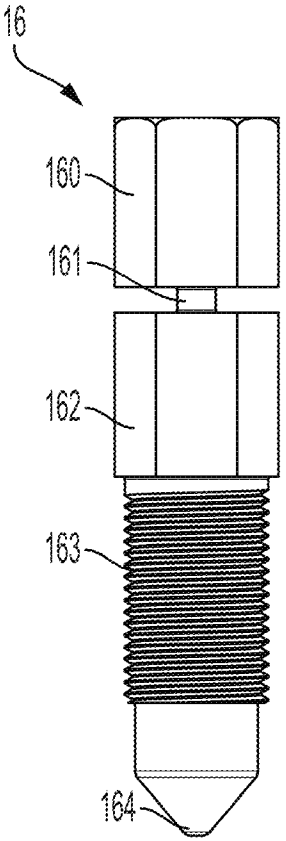
FIG. 5B is a left view of a shear bolt according to an embodiment.
Figure 5A:
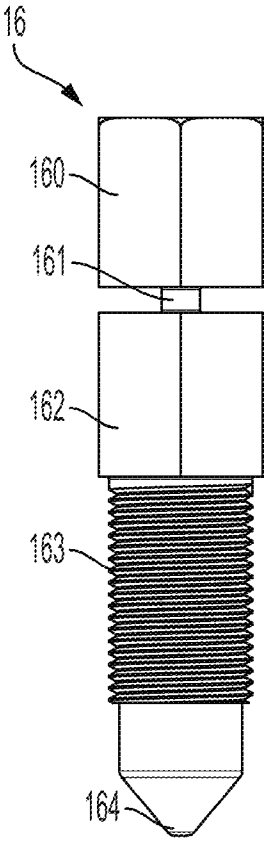
FIG. 5A is a front view of a shear bolt according to an embodiment.

Referring now to FIG. 1, a wedge connector assembly with sequential shear bolts ("connector assembly"), referred to generally by reference numeral 10, according to an embodiment is generally comprised of, without limitation, shell 12, wedge 14, and at least one shear bolt 16. The connector assembly 10 can be conductive such that it allows the flow of electricity between two conductors (see FIG. 15) positioned within channels 122 of shell 12 (see FIG. 3D). When put together as one example shows in FIG. 2, wedge 14 can be received by shell 12 and at least one bolt 16 can be placed through apertures (126, 146) formed through both wedge 14 and shell 12. As shown, shell 12 includes apertures 126 (positioned through a top and a bottom surface of the shell 12) each of which can line up and pair, respectively, with an aperture 146 (positioned through a top and a bottom surface of the wedge 14). Each aperture pair is configured to receive a sheer bolt 16, each of which is configured to be positioned through an aperture pair at an angle (preferably substantially perpendicular or actually perpendicular) to the plane of the top surfaces of the shell and of the wedge.

Referring now to FIGS. 3A-D, in one embodiment shell 12 comprises a top surface 120, a bottom surface 121, two channels 122, a middle portion 123, a first end 124, a second end 125, and at least one opening 126. The shell 12 can be tapered toward the second end 125. Shell 12 can be generally c-shaped as shown or can be any shape such that it can accept at least two conductors and wedge 14. The top and bottom channels 122 extend between the first end 124 and the second end 125 and can be formed by the edges curving in toward the top surface 120 of the middle portion 123 to form the c-shape. Channels 122 can also be accomplished by other suitable means such as casting or cutting a groove (as should be understood by a person of ordinary skill in the art in conjunction with a review of this disclosure). Channels 122 are each configured to accept a conductor such as a conductive wire. The channels 122 of shell 12 can serve as a bearing surface for the wedge 14 to press conductors against.

In one example, shell 12 defines at least one aperture or opening 126 through the top surface 120 to the bottom surface 121. In another example the opening 126 can also be formed through the top surface 120 and not extend all the way through the bottom surface 121. In the example shown, the shell 12 defines three collinear openings 126 positioned near the center of the middle portion 123. Alternatively, the openings 126 can be positioned off colinear and off center, include two rows of colinear off center openings 126, or non-colinear openings 126 (e.g., zig zag design)). Each aperture 126 is configured and dimensioned to accept a shear bolt 16. The openings 126 can be any shape such as but not limited to oblong shaped or circular, and can collectively be the same shape or can be different shapes.

In another example, the first opening 126 positioned closest to the second end 125 can be longer and larger than the sequential openings 126 that are positioned further from the second end 125. In an example with three opening, the opening closest to the second end 125 (the first opening) can be the largest, and middle opening (the second opening) can be smaller than the first opening but larger than the opening closest to the first end 124 (the third opening). While the example described has three openings 126, shell 12 can define any number of openings 126 and can be any relation of sizes including the same or different. It can be useful for the first opening to be larger than the next openings as it allows the bolts to be driven down in a position closer to the first end 124 of the shell 12, as the next shear bolt 16 is driven down the conical tip 164 can slide into the edge of the second opening closest to the first end 124 of the shell 12 moving the wedge 14 and the first shear bolt toward the second end of the shell 12 as the second bolt 16 is driven down. This process is repeated for every subsequent bolt 16. According to another embodiment, apertures 126 can have threads that correspond to threads on shear bolts 16.

Referring now to FIGS. 4A-D, the wedge 14 can be dimensioned and shaped to be received by the shell 12 and can help to hold conductors within the shell 12. In the example shown, wedge 14 comprises a top surface 140, a bottom surface 141, two grooves 142, a middle portion 143, a first end 144, a second end 145 and at least one aperture 146. The wedge 14 can be tapered toward the second end 145 and can have a shape and features that correspond to shell 12. Grooves 142 can be dimensioned and shaped to be in communication with conductors. When in a secured position within shell 12, wedge 14 can provide a constant pressure against the conductors, pushing them against the channels 122 of the shell 12.

The middle portion 143 defines at least one aperture 146 going through the top surface 140 and bottom surface 141. The apertures can each be shaped and sized to accept a shear bolt 16 and strategically positioned to aid in the thrusting of the wedge 14 tighter into the shell 12. The number and positioning of apertures 146 on the wedge 14 can correspond to the number and positioning of openings 126 on the shell 12. In one example, the apertures 146 are equally sized collinear apertures 146, however the apertures 146 can also be of different sizes and not linear.

According to another embodiment, apertures 146 can also have threads that correspond to threads on shear bolts 16. The middle portion 143 of the wedge 14 can run between the first end 144 to the second end 145 of the wedge 14 and in one example can be thicker from the top surface 140 to the bottom surface 141 than the rest of the wedge 14. The middle portion 143 should be thick enough to provide enough threading for the shear bolt 16 while also allowing the shear bolts 16 to bare against wedge 14. The middle portion 143 should also be thin enough to allow the tip of the shear bolt 16 to be recessed to the edge of the shell 12 for the insertion process (as should be understood by a person of ordinary skill in the art in conjunction with a review of this disclosure).

Shear bolts 16 are configured to perform multiple tasks. Referring now to FIGS. 5A-D, according to one embodiment shear bolt 16 comprises (from proximal end to distal end) a first head 160, a breaking point 161, a second head 162, a threaded portion 163, and a tip 164. The shear bolts 16 can be configured to break at the breaking point 161 when the shear bolt 16 reaches full torque tightness. The shear bolts 16 can be accomplished by shear bolts such as those generally known in the art alternatively other bolts or screws can also be used. The breaking point 161 can yield to pressure and break allowing the first head 160 to detach from the rest of the shear bolt 16 at a point when the wedge 14 is sufficiently moved into the shell 16 to secure the conductors therein (as should be understood by a person of ordinary skill in the art in conjunction with a review of this disclosure). The breaking point 161 can break when the shear bolt 16 bottoms out on the wedge 14. This helps to prevent over tightening of the shear bolts 16. The breaking point 161 can be accomplished by the shear bolt 16 having a specified small diameter cut to provide a predictable separation of the shear bolt 16 shaft at this point when an acceptable torque has been achieved during installation or other methods as should be known in the art.

The conical tip 164 provides for the thrusting of the wedge 14 further into the shell 12 between the conductors when the shear bolt 16 is being inserted. The threaded portion 163 of the shear bolt 16 allows for the driving action of the shear bolt 16 like a normal bolt 16 or screw. The conical tip 164 of the shear bolt 16 can be configured to provide a ramp effect for the thrusting action of the wedge 14. When the shear bolt 16 is inserted further into the wedge 14, the conical tip 164 forces the wedge 14 further into the shell 12 toward the second end 125 of the shell 12 and tighter against the conductors. The apertures 146 in the shell 12 are dimensioned and positioned to receive the shear bolts in a way that forces a thrusting action of the wedge 14 further into the shell 12 against the conductors to be joined when the shear bolts are installed in the correct order.

If a particular assembly requires less thrust distance, a lower number of shear bolts 16 may provide sufficient thrust distance. A larger conductor 10 combination may require a higher number of shear bolts 16. Also, a different diameter of shear bolts 16 may be used for different assemblies. The number of shear bolts 16 and corresponding apertures 146 of a particular connector assembly 10 can be used to complete an assembly. In one example, each connector assembly 10 assembly comes with an amount of shear bolts 16 matching to the number of apertures 146 and openings 126. In another embodiment, a shear bolt 16 that fits multiple different assemblies can be used such that the same or similar type of shear bolts 16 could be used in different models. This would allow a user to have extra or replacement shear bolts 16. This would be an advantage for a user in situations where one is dropped or broken.

Figure 6:
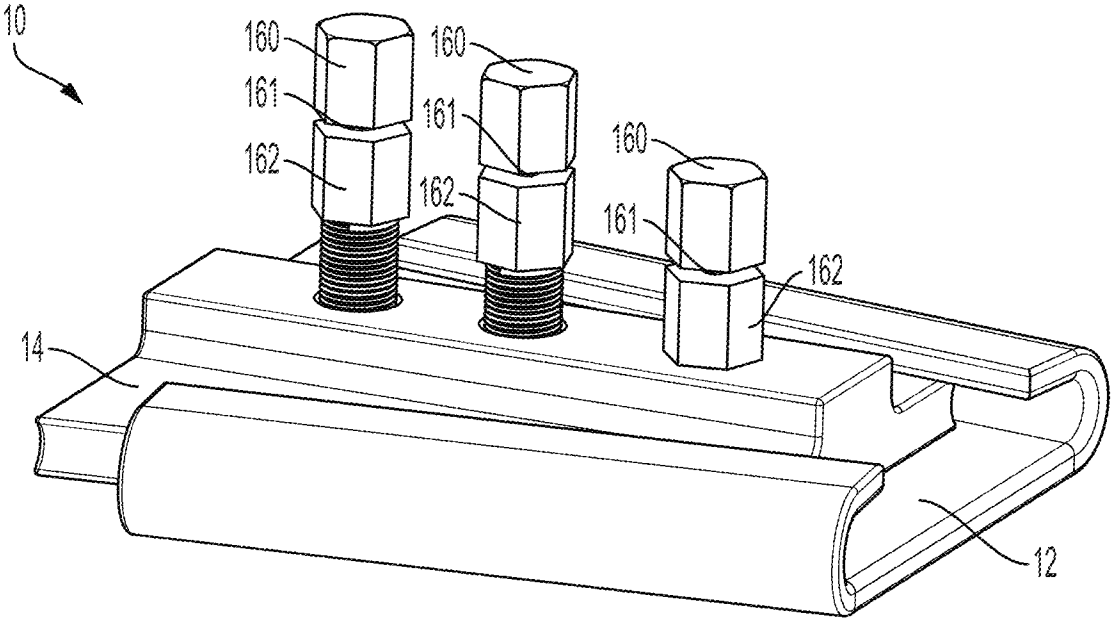
FIG. 6 is a perspective view of a wedge connector assembly with sequential shear bolts according to an embodiment.

Referring now to FIG. 6, there is shown an example, of the shear bolts 16 placed into the connector assembly 10 and have both the first head 160 and the second head 162. The first head 160 and second head 162 can be hexagonal shaped or any shape as should be known in the art that can be accepted by a tool. The first head 160 can be used for installation. When the first head 160 has been used to drive in the shear bolt 16 into the connector assembly 10 to final torque, it separates from the rest of the shear bolt 16 at the breaking point 161. The second head 162 of the shear bolt 16 is closer to the conical tip 164 and on the other side of the breaking point 161. The second head 162 remains on the shear bolt 16 after installation and can be used to remove the shear bolt 16 for removing the connector assembly 10.

Figure 7:
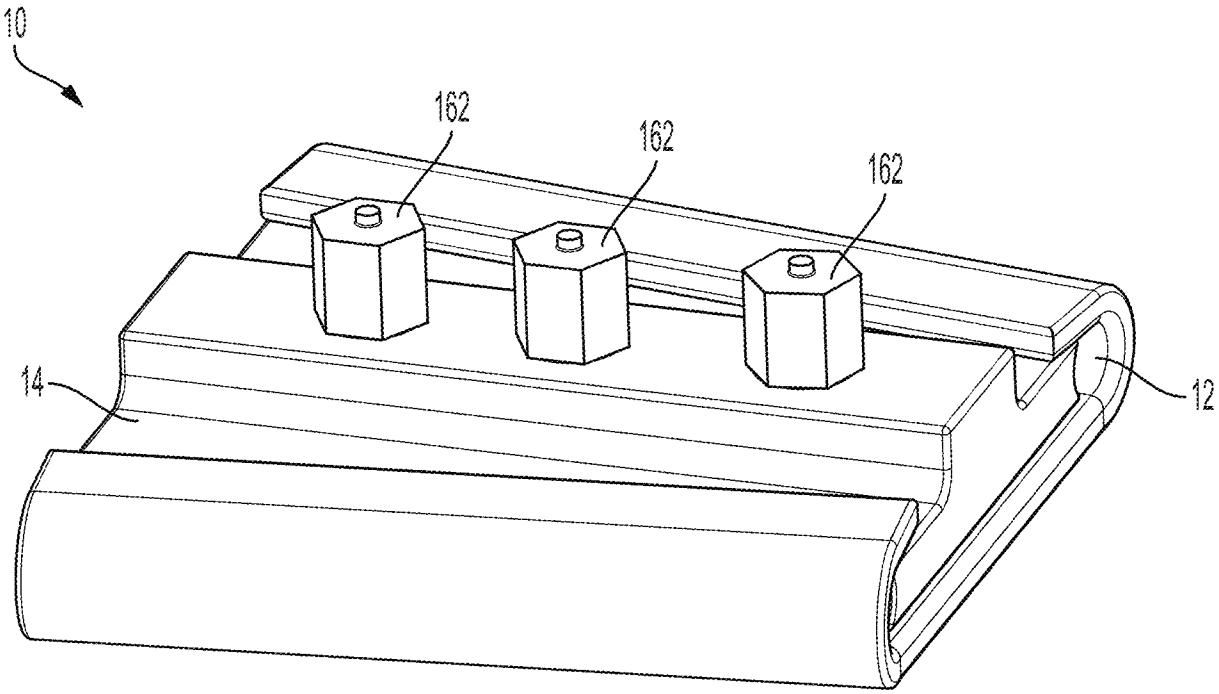
FIG. 7 a perspective view of a wedge connector assembly with sequential shear bolts according to an embodiment.

Each sheer bolt 16 can be designed to be used one time as the breaking point 161 separates the first head 160 from the second head 162 during installation. In some but not all embodiment, each sheer bolt 161 can be configured to break at a different torque/force. FIG. 7 show examples of the shear bolts 16 and connector assembly 10 when installed, in this example the first head 161 is no longer attached. At completion of installation, the final shear bolt 16 fully locks the wedge 14 into the shell 12 at the proper force and distance within the shell 12. After the successful installation of the final shear bolt 16, the previously installed two shear bolts 16 provide stability on the axis of thrust, but in some (but not all) embodiments do not maintain pressure on the wedge 14 into the shell 12

The shell 12 and wedge 14 can be made of any conductive material suitable in the art such as but not limited to aluminum alloy. These components are preferably conductive by nature, as the wedge 14 conductor provides a mechanical connection between conductors, as well as a path for electrical current flow. In one example, where both conductors are copper, the wedge 14 can be made from compatible alloys and materials such as copper or brass. This is to prevent undesirable electrolysis which can degrade the quality of the connection over time. A user can also use connecter 10 with an oxide inhibitor paste being applied to conductor contacting surfaces and a lubricating grease applied to the conical tip 164 of the shear bolts 16.

Figure 8:
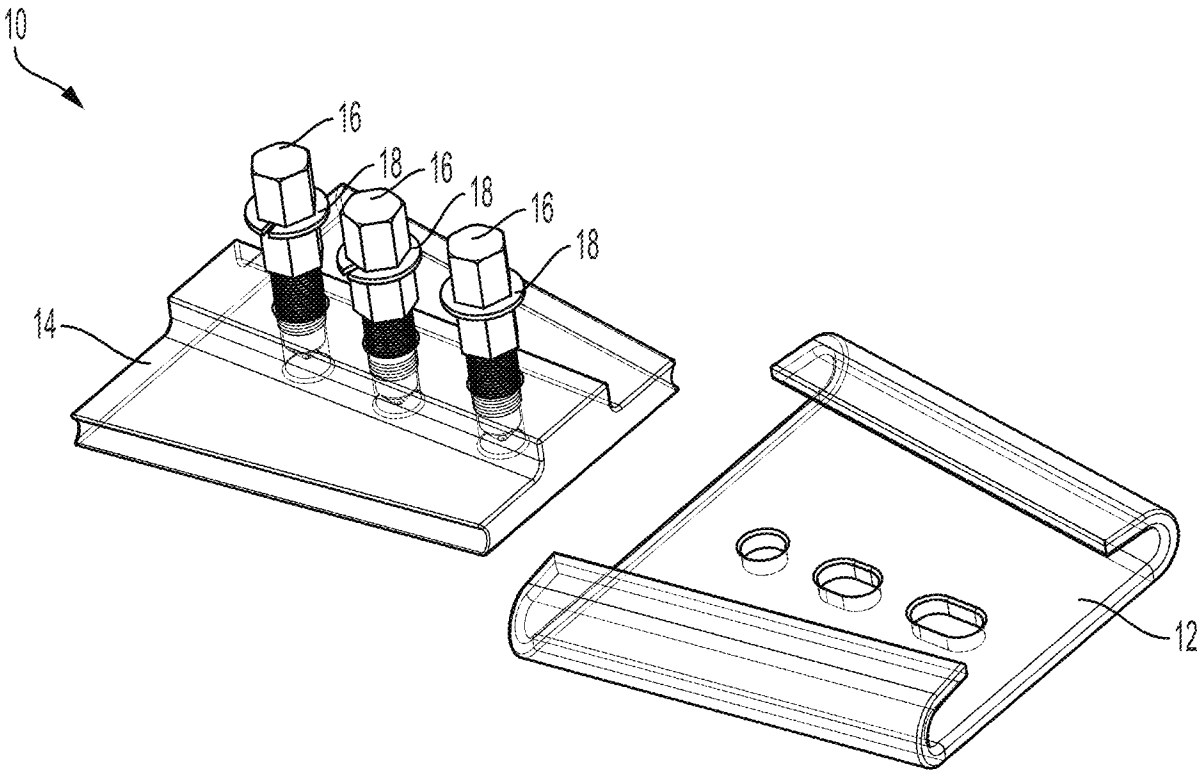
FIG. 8 is a perspective view of a wedge connector assembly with sequential shear bolts according to an embodiment.
Figure 9:
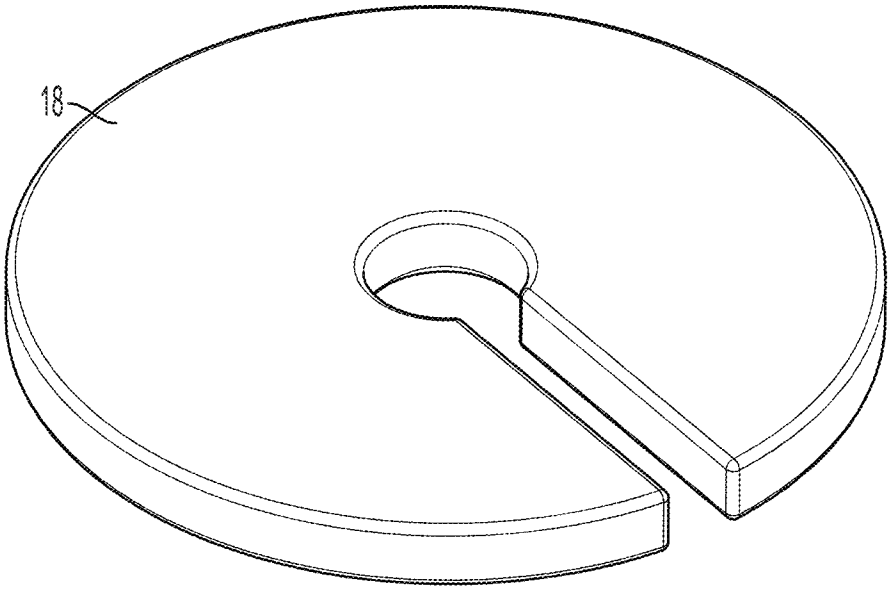
FIG. 9 is a perspective view of an installation washer according to an embodiment.

Referring now to FIGS. 8-9, there is shown an example of an installation washer 18. In one example, shear bolt 16 can have an installation washer 18 around the breaking point 161. In FIG. 9, there is shown an example of an installation washer 18. The installation washer 18 has a larger outer diameter than the first head 160 of the shear bolt 16, an inner diameter slightly larger than the breaking point 161 of the shear bolt 16, and a slot connecting these diameters to allow for it to be installed onto the unused shear bolt 16. The installation washer 18 can prevent a socket or tool from going past the first head 160 of the shear bolt 16 helps prevent the user from over tightening a bolt that does not have a breaking point 161 or preventing the breaking point 161 from breaking. The installation washer 18 can be disposable and does not have to be part of the device after installation.

Figure 10A:
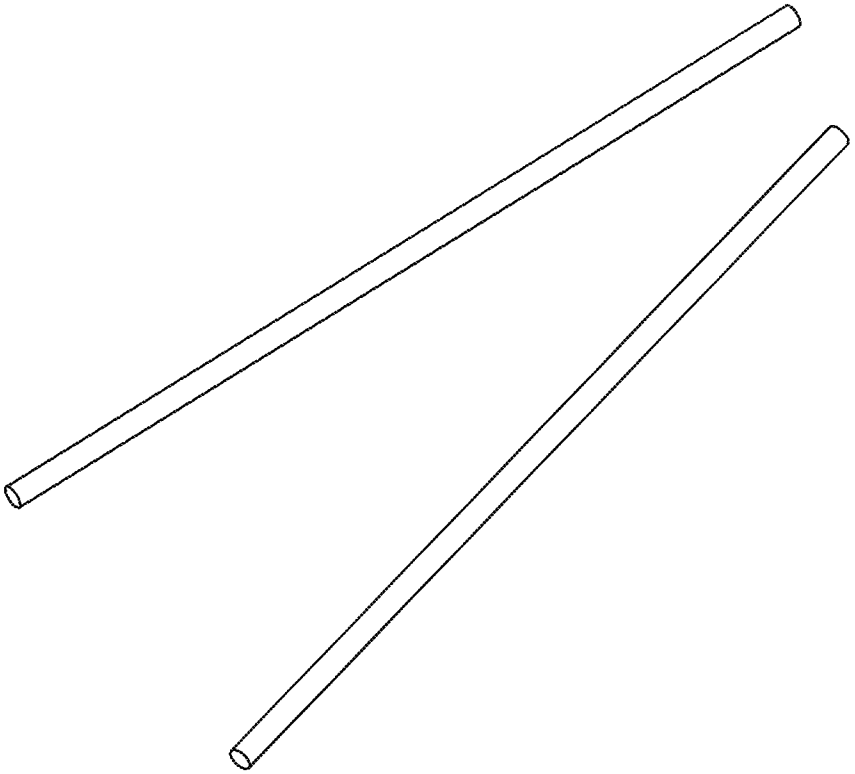
FIG. 10A is part of a flowchart illustration showing a step in the formation of a wedge connector assembly according to an embodiment.
Figure 10B:
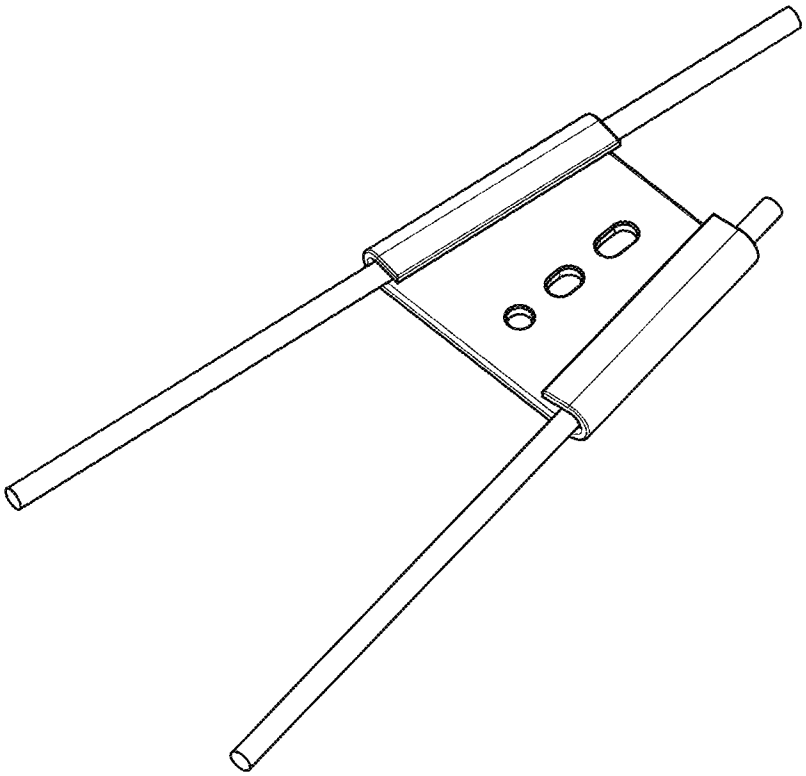
FIG. 10B is part of a flowchart illustration showing a step in the formation of a wedge connector assembly according to an embodiment.
Figure 10C:
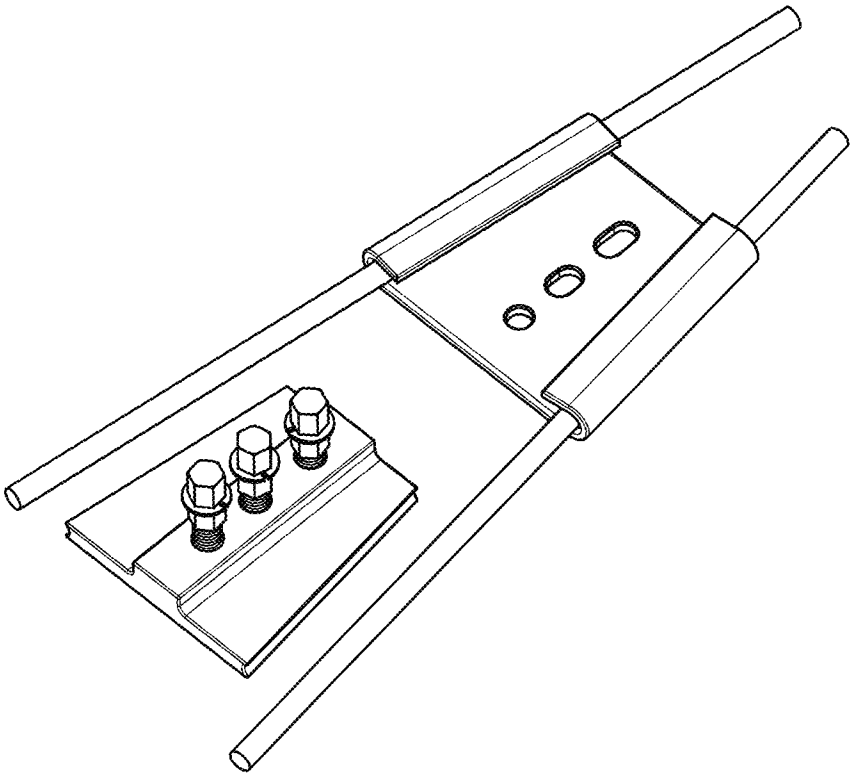
FIG. 10C is part of a flowchart illustration showing a step in the formation of a wedge connector assembly according to an embodiment.
Figure 10D:
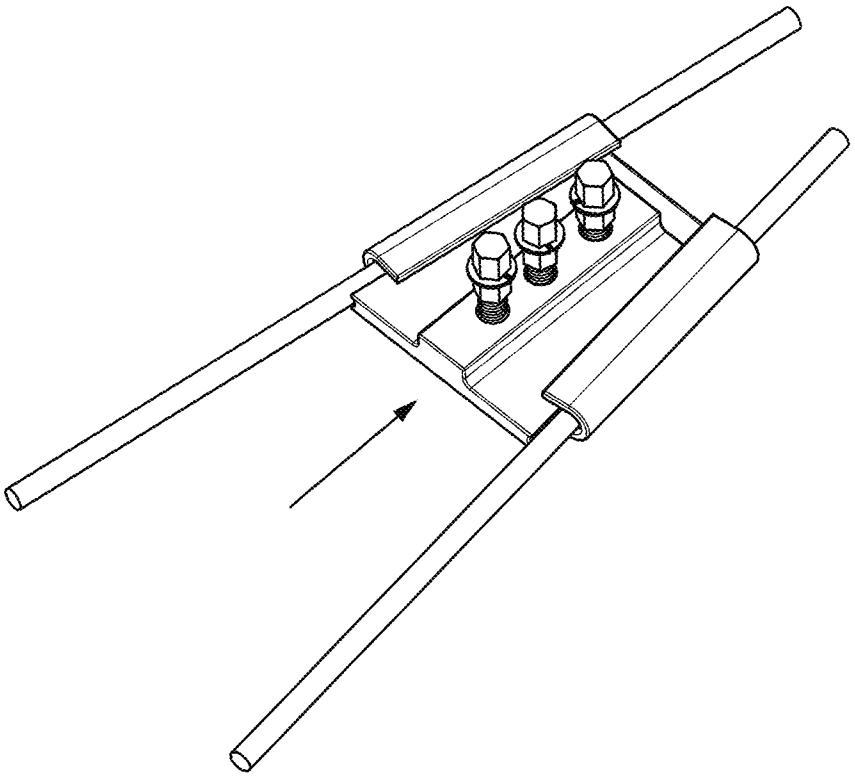
FIG. 10D is part of a flowchart illustration showing a step in the formation of a wedge connector assembly according to an embodiment.
Figure 10E:
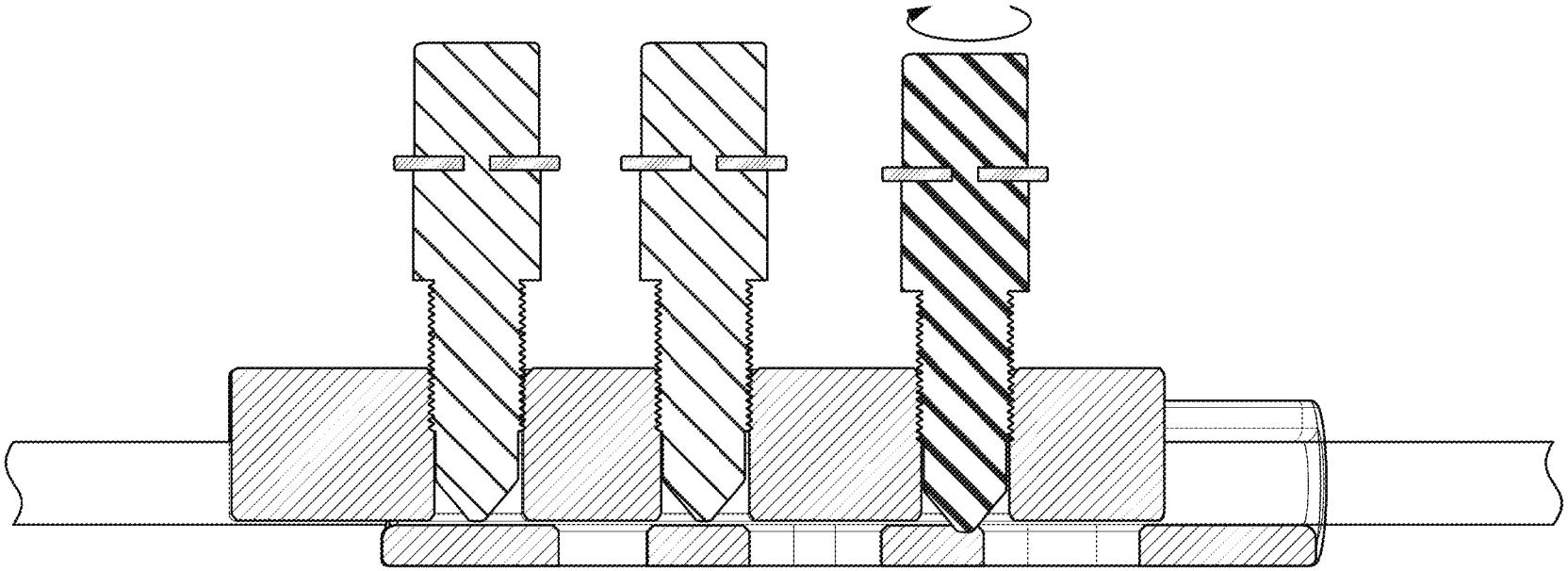
FIG. 10E is part of a flowchart illustration showing a step in the formation of a wedge connector assembly according to an embodiment.
Figure 10F:
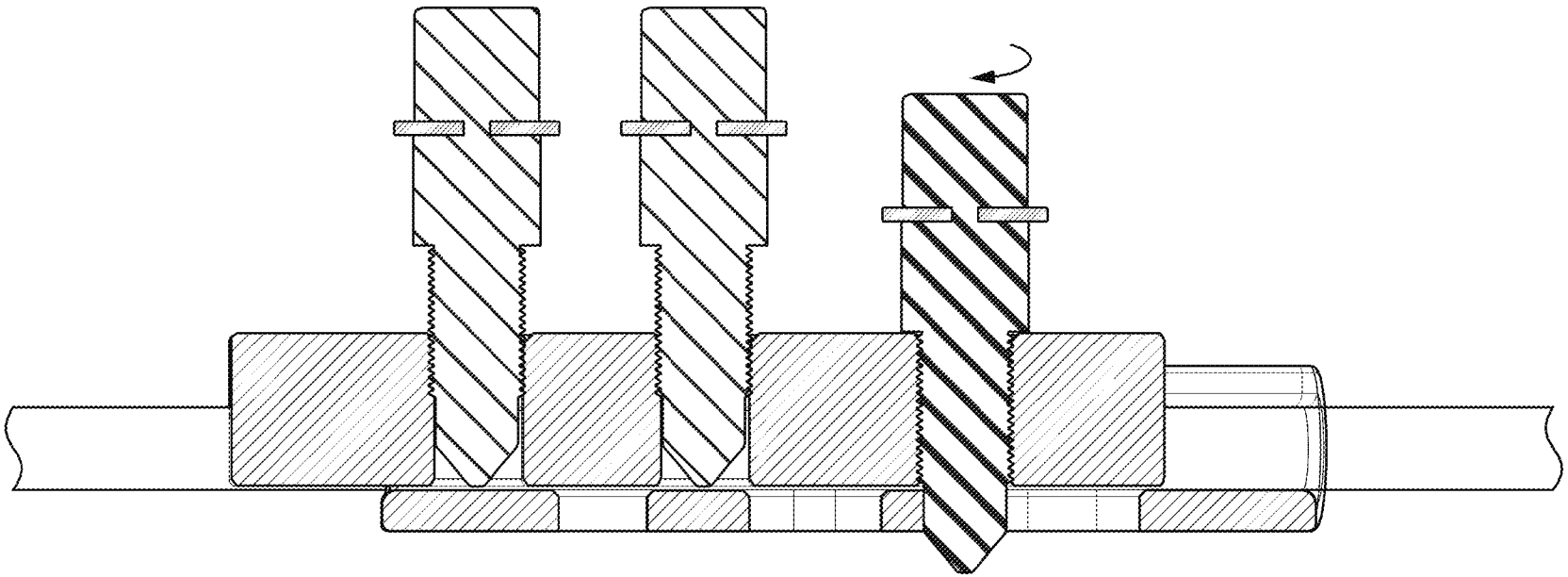
FIG. 10F is part of a flowchart illustration showing a step in the formation of a wedge connector assembly according to an embodiment.
Figure 10G:
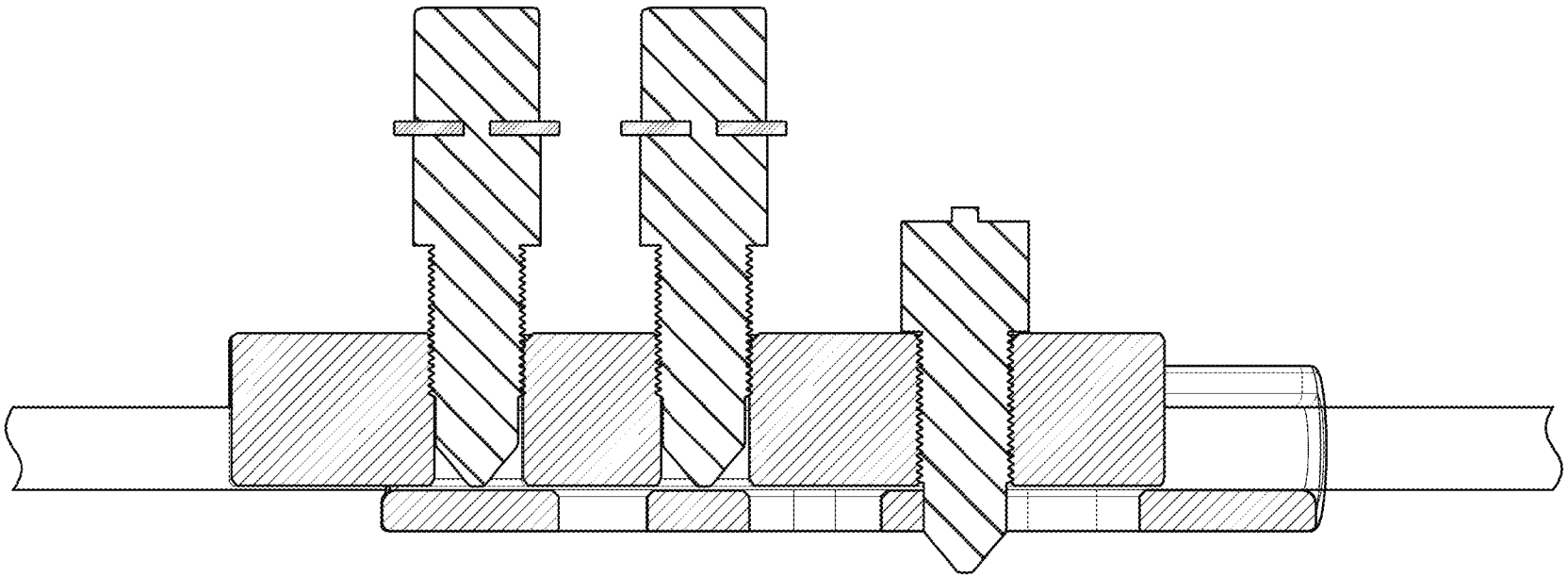
FIG. 10G is part of a flowchart illustration showing a step in the formation of a wedge connector assembly according to an embodiment.
Figure 10H:
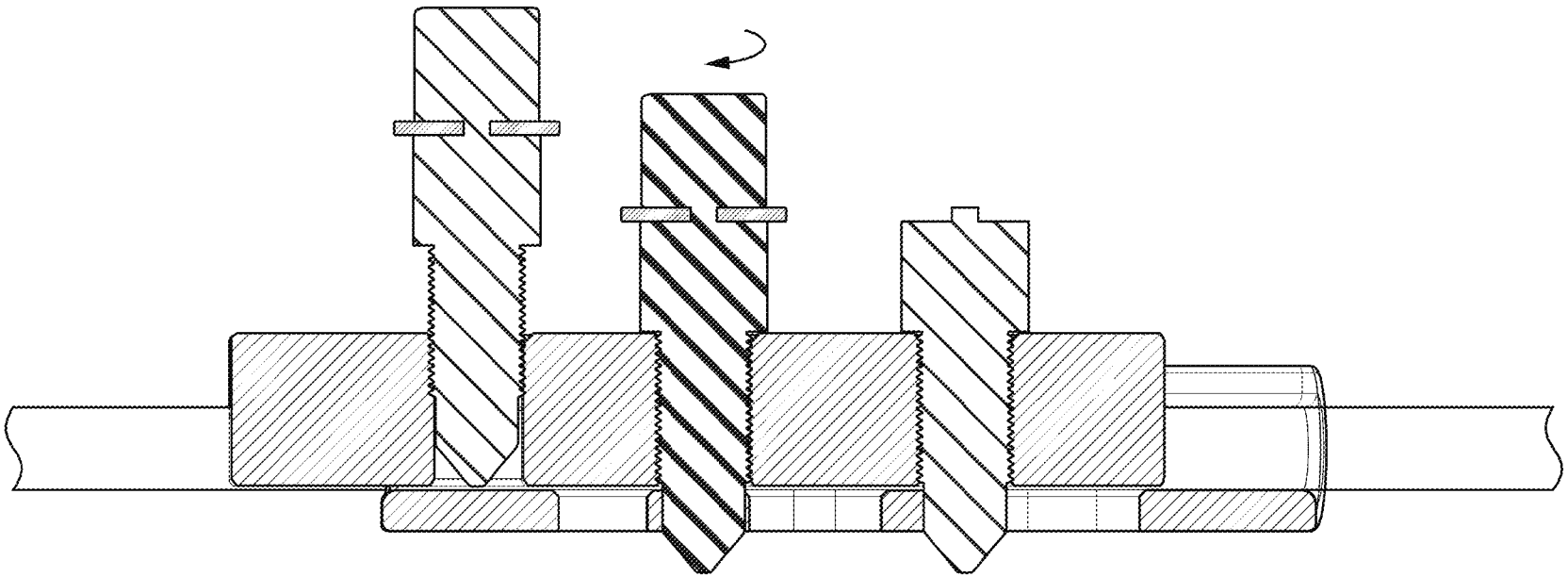
FIG. 10H is part of a flowchart illustration showing a step in the formation of a wedge connector assembly according to an embodiment.
Figure 10I:
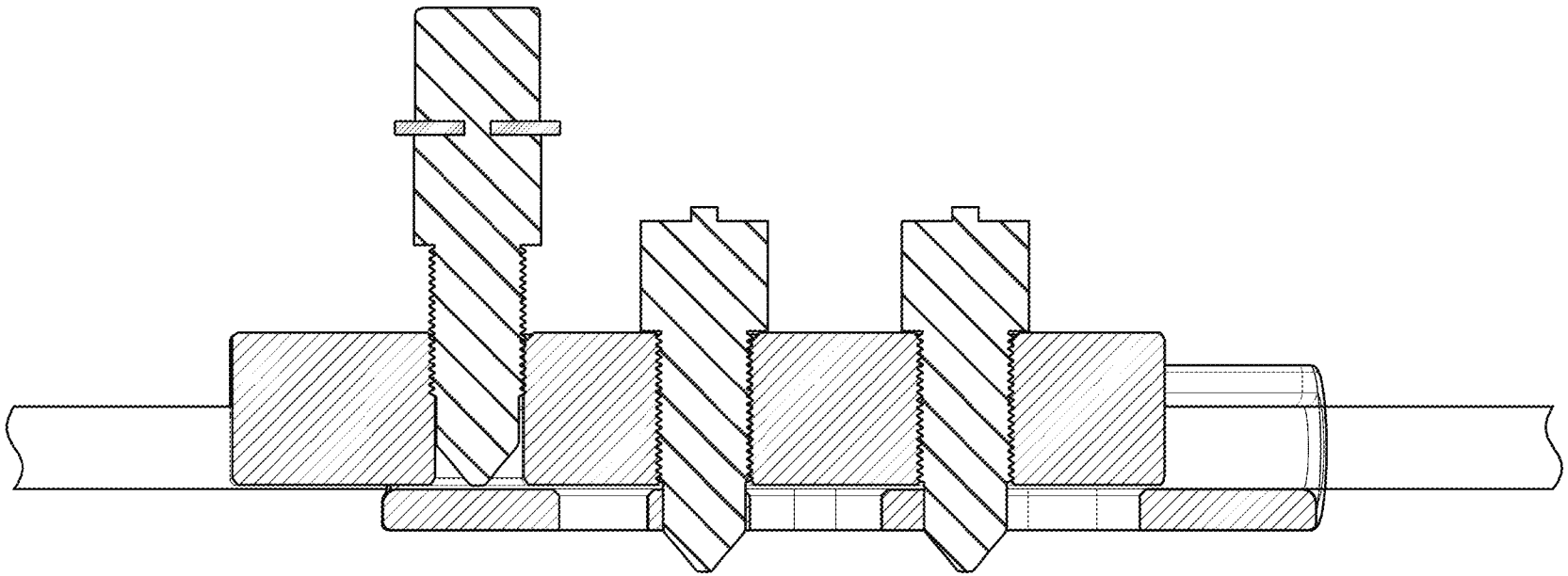
FIG. 10I is part of a flowchart illustration showing a step in the formation of a wedge connector assembly according to an embodiment.
Figure 10J:
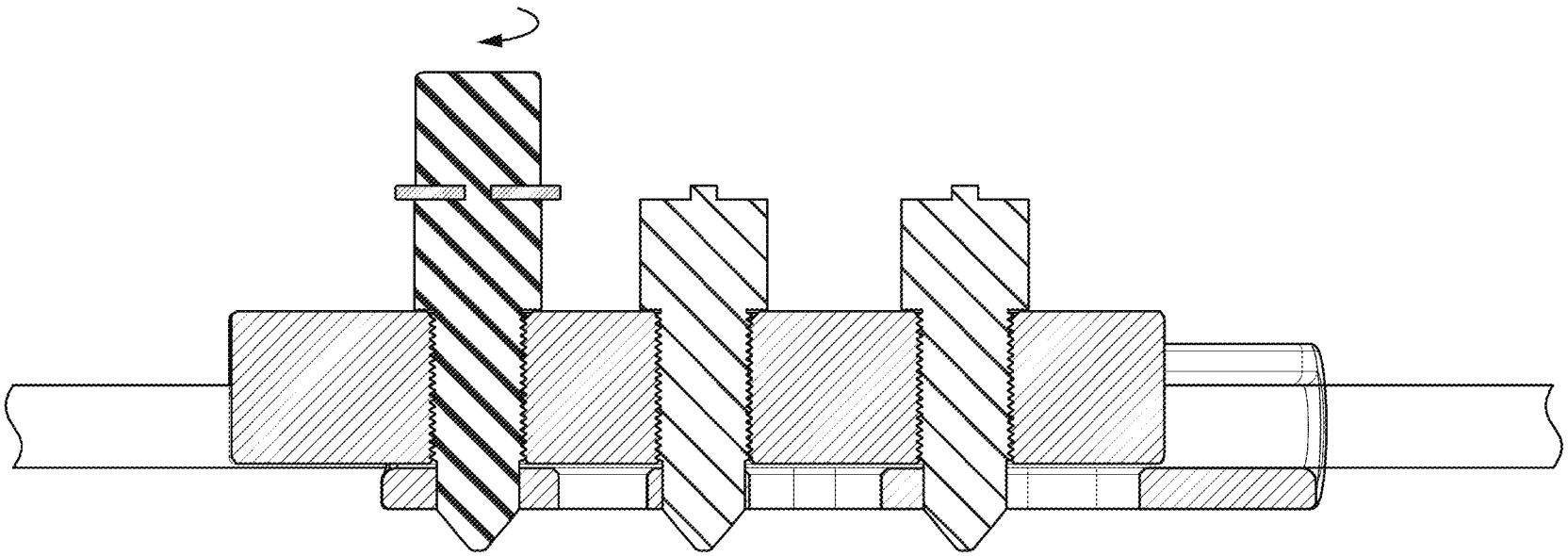
FIG. 10J is part of a flowchart illustration showing a step in the formation of a wedge connector assembly according to an embodiment.
Figure 10K:
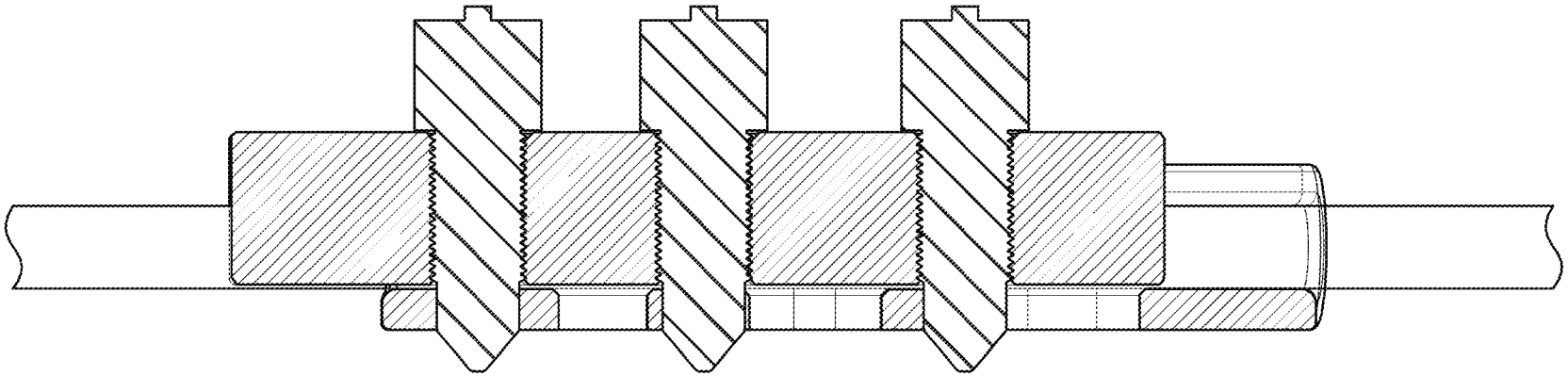
FIG. 10K is part of a flowchart illustration showing a step in the formation of a wedge connector assembly according to an embodiment.
Figure 10L:
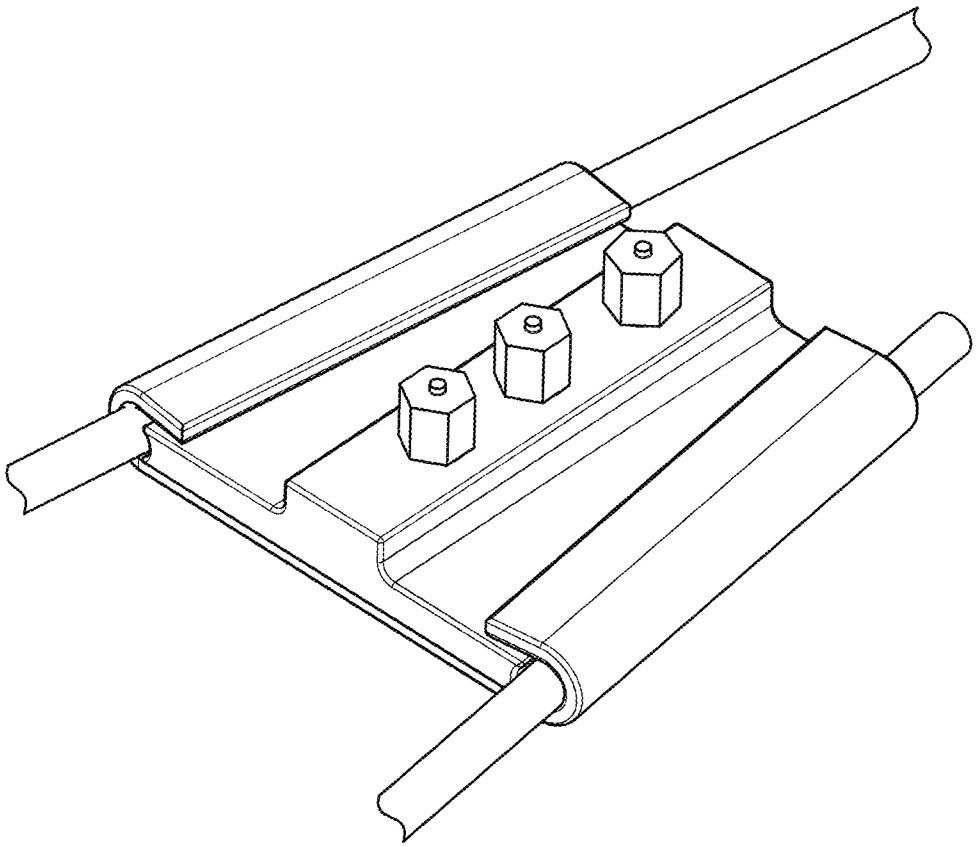
FIG. 10L is part of a flowchart illustration showing a step in the formation of a wedge connector assembly according to an embodiment.

Referring now to FIGS. 10A-L, a method for forming and installing connector assembly 10 and making an electrical connection between two conductors includes the following steps. First, the user/assembler identifies the sizes of the conductors that need to be connected or joined together and then chooses an appropriate model of the connector assembly 10 based upon those sizes (appropriate sized shells, wedges, and sheer bolts as may be necessary, as should be understood by a person of ordinary skill in the art in conjunction with a review of this disclosure). See FIG. 10A. The user then places the conductors in the channels of the shell 12, such that one conductor can be the in top channel and one can be in the bottom channel (see FIG. 10B). The user then places the wedge 14 with shear bolts (shown with installation washers) into the shell 12 between the conductors (see FIGS. 10C-D). The grooves 142 of wedge 14 should fit partially around each respective conductor. Turning to FIG. 10E, the shear bolt on the right side is shown being tightened into and through a wedge aperture and into a corresponding shell aperture, resulting in the thrusting of the wedge to the right within the shell portion. FIG. 10F shows the shear bolt on the right side fully inserted, and FIG. 10G shows the shear bolt on the right side with the first head removed based on the final torque having been reached resulting in the breaking point 161 breaking. FIG. 10H shows the middle shear bolt being tightened into and through a wedge aperture and into a corresponding shell aperture, resulting in the further thrusting of the wedge to the right within the shell portion. FIG. 10I shows the middle shear bolt with the first head removed based on the final torque having been reached resulting in the breaking point 161 breaking. FIGS. 10J-K show similar steps with respect to the left shear bolt, and the wedge being fully thrusted to the right to its final deployed/assembled condition and position. FIG. 10L shows the completed assembly and installation.

Figure 11B:
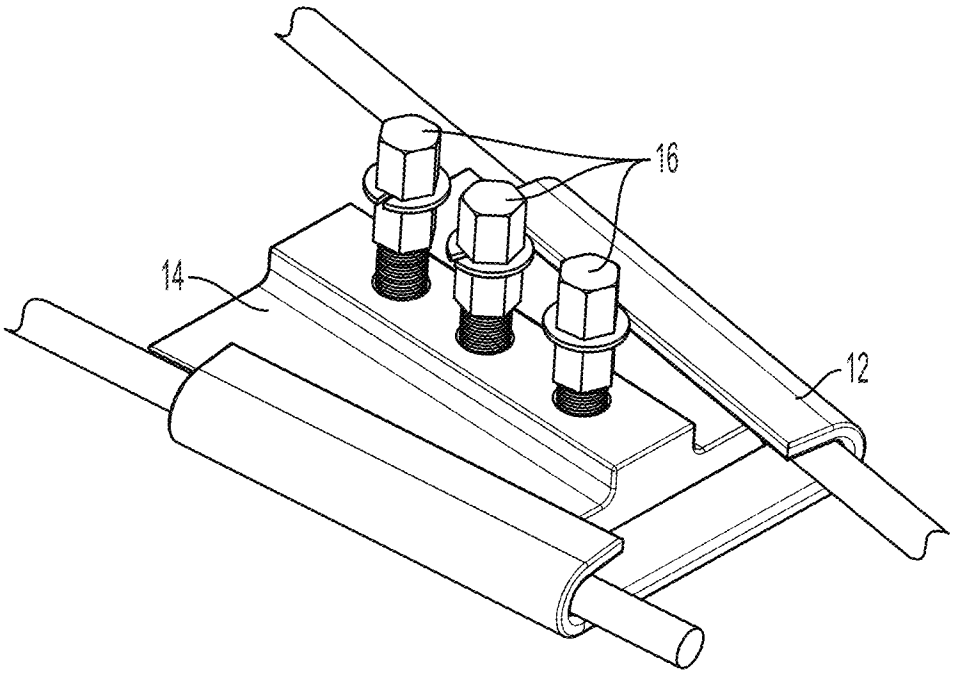
FIG. 11B is a perspective view of a wedge connector assembly with sequential shear bolts according to an embodiment.
Figure 11A:
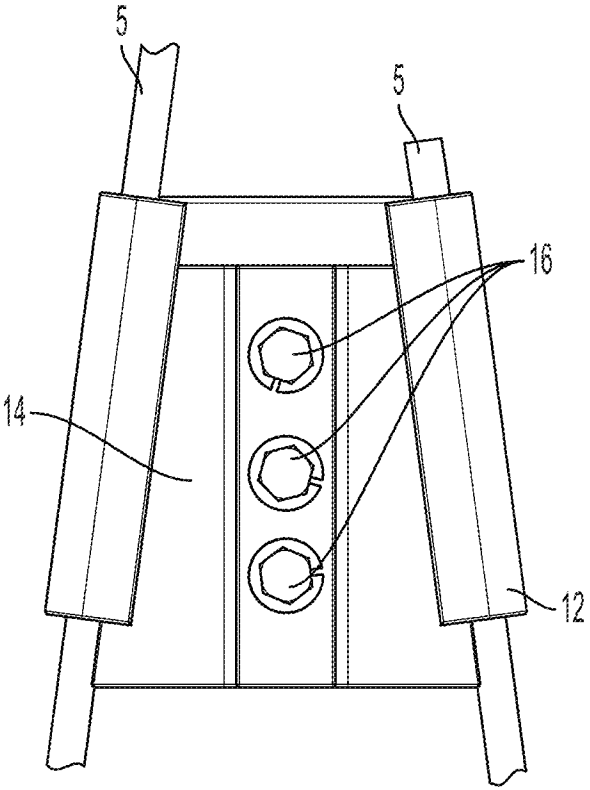
FIG. 11A is a perspective view of a wedge connector assembly with sequential shear bolts according to an embodiment.

Referring now to FIG. 11A-B, the wedge 14 should be at the correct position. If the shell 12 has a line to mark the appropriate placement of the wedge 14, the user should preferably place the wedge 14 accordingly. A slight tapping to thrust the wedge 14 in sufficiently could be needed. The tapping can only need to be done enough to align the first shear bolt 16 conical tip 164 with the edge of the first aperture in the shell 12. There are no special tools required for the placement of the wedge 14.

The user can then use a socket or tool to drive the first shear bolt 16 into the first aperture 146 in the wedge 14. If there is an installation washer 18, the socket or tool can bear against the portion of the shear bolt 16 to only the portion of the shear bolt 16 above the installation washer 18. By driving the first shear bolt 16 down into the wedge 14, the conical tip 164 of the first shear bolt 16 can be forced into the corresponding opening 126 in the shell 12. The conical tip 164 of the shear bolt 16 can be configured to slide into opening 126, moving the wedge 14 over toward the second end 125 of the shell 12 slightly with each bolt 16 that can be driven down. The user can continue driving the shear bolt 16 into the wedge 14 until final torque has been reached. The shear bolt 16 can preferably only be driven in as far as the top of the rise in the middle portion 143 of the wedge 14. When this point has been reached, and sufficient torque has been applied, the breaking point 161 can separate, and the second head 162 the installation washer 18 can fall away.

The user can then proceed to do the same thing to the remaining shear bolts 16 in sequential order from closest to the second end 145 of the wedge 14 to farthest from the second end 145 of the wedge 14. Driving the shear bolts 16 in sequential order allows each subsequent shear bolt 16 to align with its respective opening 126. Each successive shear bolt 16 can be aligned enough for the conical tip 164 to start into its respective opening 126 without the need for further tapping of the wedge 14. Once the final shear bolt 16 has been fully installed to final torque, the installation is complete.

Figure 12B:
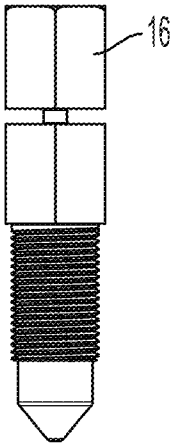
FIG. 12B is a perspective view of a shear bolt according to an embodiment.
Figure 12A:
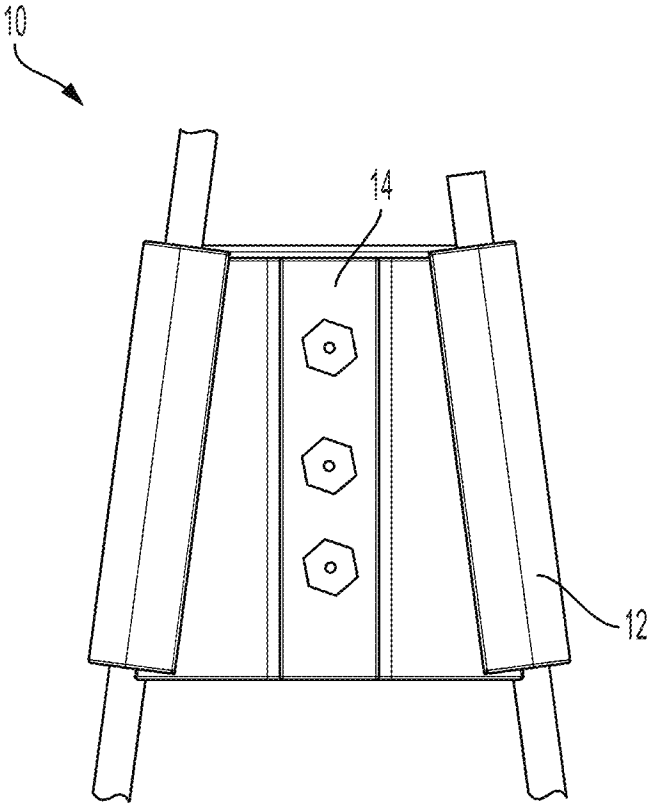
FIG. 12A is a perspective view of a wedge connector assembly with sequential shear bolts according to an embodiment.

The connector assembly 10 can be any suitable size and can be made to accept various diameters of conductors, the shell 12 can be in appropriate sizes to be compatible with the conductors needing to be connected. However, depending on the size of conductors needing to be joined, the size of the connector assembly 10 can be different to make a more optimally sized assembly. The height of the connector assembly 10 can be greatest before the shear bolts 16 have been fully installed as the shear bolts 16 have not separated at the breaking point 161. In one example, the height can be 4⅜" and another ¾" for the thickness of the shell 12. The connector assembly 10 can be reduced considerably with the elimination of unneeded materials. For example, the 9.71" shown in FIG. 12A-B can be reduced by almost 4" for the same conductor combination, and still retain the properties necessary for installation.

If a connector assembly 10 selected for the conductors to be joined is too large, the final shear bolt 16 may not provide a tight connection. If the conductors can't fit tightly between the wedge 14 and the shell 12, it may be apparent that another size connector assembly 10 may need to be selected to match the conductor sizes. If a connector assembly 10 assembly selected for the conductors to be joined is too small, it most likely will not be possible to start driving the first shear bolt 16.

Figure 13:
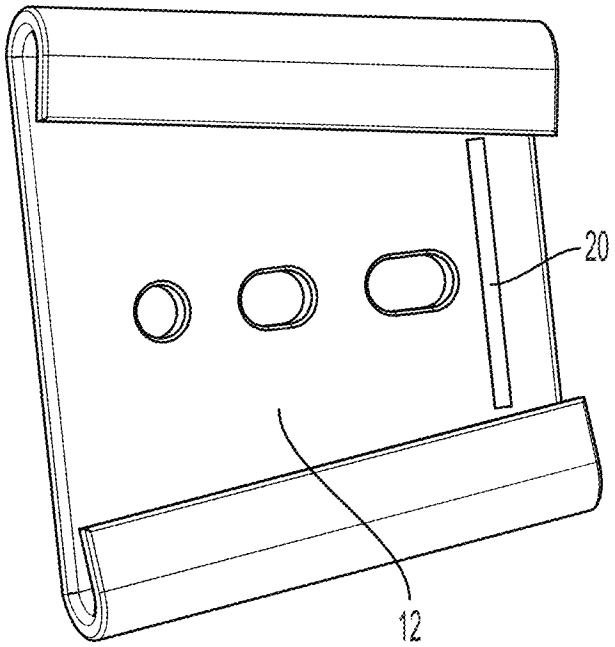
FIG. 13 is a perspective view of a wedge according to an embodiment.
Figure 14B:
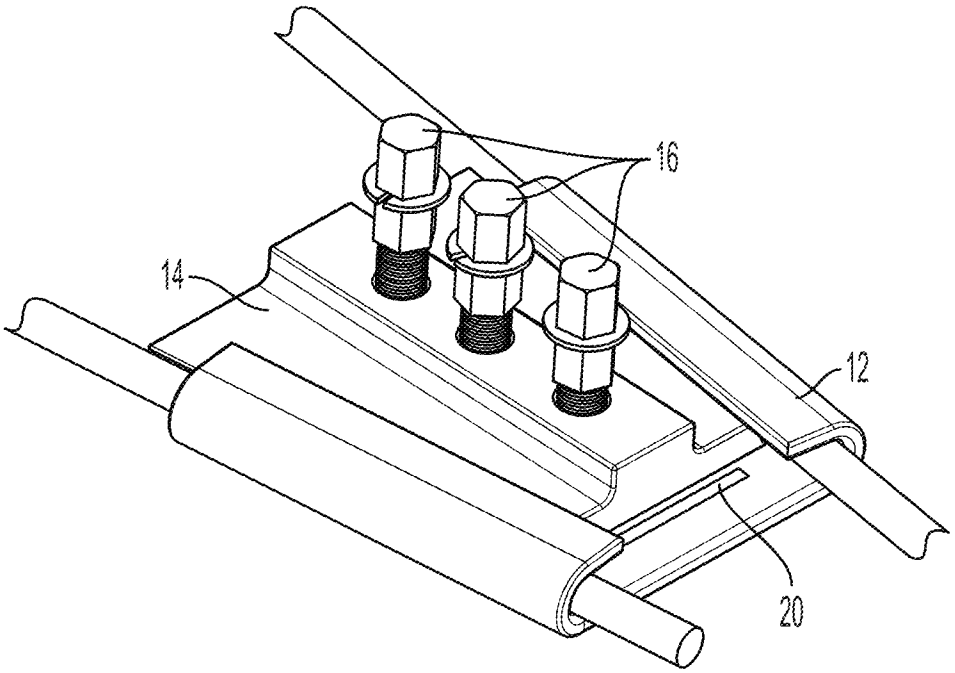
FIG. 14B is a perspective view of a wedge connector assembly with sequential shear bolts according to an embodiment.
Figure 14A:
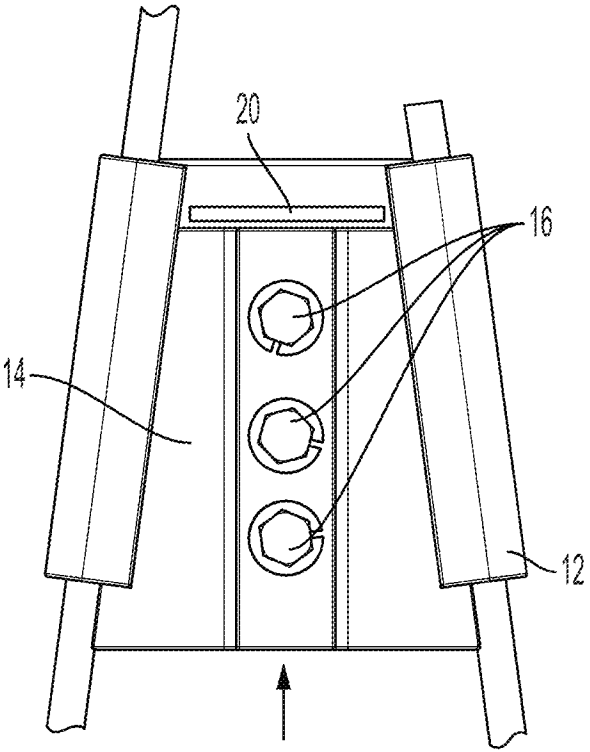
FIG. 14A is a perspective view of a wedge connector assembly with sequential shear bolts according to an embodiment.

Referring now to FIGS. 13-14, in another embodiment there can also be a line on the shell 12 that indicates proper initial placement of the wedge 14 within shell 12. The line can ensure sufficient positioning of the wedge 14 far enough into the shell 12 prior to driving the first of the shear bolt 16. The line can be beneficial to the user to prevent premature shear bolt 16 driving before the conical end of the shear bolt 16 can be aligned with its respective aperture. The line can be accomplished by any suitable means such as but not limited to a painted line or mark or an impression. In use, a user inserts the wedge 14 far enough into the shell 12 that the line can be fully covered prior to screwing in the first of the shear bolts 16. The line can be located anywhere along the shell 12. In another example, a line can be used to indicate completed installation. The line can be visible from a distance for inspection, or just large enough for the user to see.

Hot-sticking and rubber gloving are two work practices used to work on energized high voltage power lines. Hot-sticking uses the concept of the user maintaining a safe distance from energized objects. This is done by using electrically insulating poles/tools to allow work on the energized objects from a remote location. The connector assembly 10 can be compatible with this work practice, as readily available tools and techniques already in use with hot-sticking methods can be used in connector assembly 10 installation and removal. The tools required for hot sticking usually include two shotguns, and a socket stick/hammer drill or a hot hammer.

Rubber gloving uses the concept of shielding the user from energized objects and working at a closer distance. This is done by the user using electrically insulating gloves/sleeves/cover to allow work on the energized objects at a close distance. The connector assembly 10 can be compatible with this work practice, as readily available tools and techniques already in use with rubber gloving methods can be used in connector assembly 10 installation and removal. The tools required for rubber gloving include a hammer and a ratchet/hammer drill. A user can also tap the wedge 14 in with the butt of the gun. When the high voltage lines are not energized, the connector assembly 10 can also be installed and removed using readily available conventional tools.

Removal of connector assembly 10 can be simple and easy. To remove connector assembly 10, a user can remove the shear bolts 16 using a socket or similar tool, and then remove the wedge 14 from the shell 12 and the shell 12 from the conductors.

Figure 15:
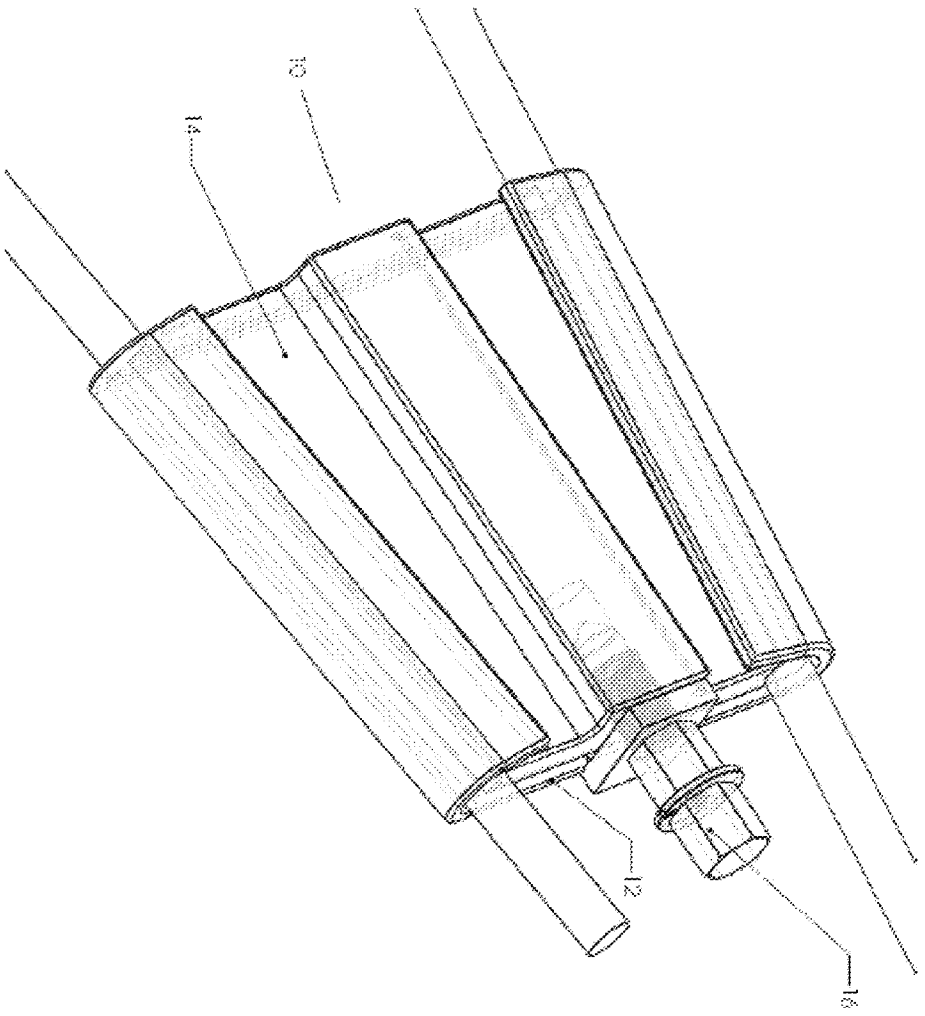
FIG. 15 is a perspective view of a wedge connector assembly with sequential shear bolts according to an alternate embodiment.

In another embodiment the shear bolt 16 orientation, shape, and overall function can be different. For example, the shear bolt 16 can be aligned as shown in FIG. 15, with the axis of the shear bolt's rotation being parallel with the direction of the wedge 14's thrust movement. As the shear bolt 16 is tightened, the shear bolt 16 can draw in the wedge 14. In another example, a connector assembly 10 can also include a large rectangular ring to provide a connection point or perch for a temporary electrical connector assembly 10 or hot tap.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as, "has" and "having"), "include" (and any form of include, such as "includes" and "including"), and "contain" (any form of contain, such as "contains" and "containing") are open-ended linking verbs. As a result, a method or device that "comprises", "has", "includes" or "contains" one or more steps or elements. Likewise, a step of method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts and equivalents of all means or step plus function elements in the claims below, if any, are intended to include any structure, material or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of one or more aspects of the invention and the practical application, and to enable others of ordinary skill in the art to understand one or more aspects of the present invention for various embodiments with various modifications as are suited to the particular use contemplated.

What is claimed is:

1. An electrical connector assembly, comprising:

at least one bolt having a tapered distal end;

a wedge having a top surface and a bottom surface defining a plurality of apertures extending between and through the top and bottom surfaces, and dimensioned to receive the bolt therethrough;

a shell having a top surface, a bottom surface, a first end, and a second end, the shell further defining a first channel and a second channel extending from the first end to the second end of the shell, the first and second channels being separated by a middle portion such that the first and second channels are spaced to receive the wedge therebetween; and a first opening and a second opening extending between the top surface to the bottom surface of the shell and the openings are each dimensioned to receive the bolt therethrough, wherein the openings are configured to be positioned to align and pair with the plurality of apertures when the wedge is positioned between the first and second channels wherein the first opening comprises a first shape and a first size and the second opening comprises a second shape and a second size wherein the first size and first shape are different from the second shape and the second size, respectively.

2. The assembly of claim 1, wherein the shell has a width that tapers from the first end to the second end of the shell.

3. The assembly of claim 1, wherein the first and second channels extend from the first end to the second end of the shell parallel to a plane defined by the top surface.

4. The assembly of claim 1, wherein the at least one bolt is a shear bolt.

5. The assembly of claim 1, wherein the at least one bolt has a threaded portion.

6. The assembly of claim 5, wherein each of the plurality of apertures has a threading that corresponds to the threaded portion of the at least one bolt.

7. The assembly of claim 1, wherein the wedge has three apertures and the shell has three corresponding openings, wherein each of the three wedge apertures is configured to be positioned to align and pair with a respective shell aperture when the wedge is positioned between the first and second channels.

8. The assembly of claim 1, wherein the at least one bolt includes an installation washer positioned therearound.

9. The assembly of claim 1, wherein the at least one bolt is positioned at an angle to the top surfaces of the wedge and the shell when the at least one bolt is positioned through each of the first opening and the second opening.

10. The assembly of claim 9, wherein the at least one bolt is perpendicularly positioned to the top surfaces of the wedge and the shell when the at least one bolt is positioned through each of the first opening and the second opening.

11. The assembly of claim 1, wherein the at least one bolt is configured to move the wedge toward the second end of the shell when the at least one bolt is inserted through the first opening and the second opening.

12. The assembly of claim 1, wherein the wedge further comprises a first side surface having a first groove configured to receive a portion of a first conductor and hold the first conductor via friction fit within the first channel.

13. An electrical connector assembly, comprising:

a first bolt having a tapered end;

a second bolt having a tapered end;

a wedge having a top surface and a bottom surface and defining a first aperture and a second aperture extending between and through the top and bottom surfaces, the first aperture is dimensioned to receive the first bolt therethrough and the second aperture is dimensioned to receive the second bolt therethrough;

a shell having a top surface, a bottom surface, a first end, and a second end, the shell further defining a first and a second channel extending from the first end to the second end of the shell, the first and second channel being separated by a middle portion such that the first and second channel are spaced to receive the wedge therebetween;

the shell further having a first opening and a second opening extending between the top surface to the bottom surface of the shell, the first opening is dimensioned to receive the first bolt therethrough and the second opening is dimensioned to receive the second bolt therethrough, wherein the first and second openings are configured to be positioned to align and pair with the first aperture and the second aperture respectively when the wedge is positioned between the first and second channels and wherein the first opening comprises a first shape and a first size, the second opening comprises a second shape and a second size, wherein the first size and first shape are different from at least one of the second shape and the second size, respectively.

14. The assembly of claim 13, wherein the shell has a width that tapers from the first end to the second end of the shell.

15. The assembly of claim 13, wherein the first and second channels extend from the first end to the second end of the shell parallel to a plane defined by the top surface.

16. A assembly of claim 13, wherein the first opening is larger than the second opening.

17. The assembly of claim 13, wherein the first and second bolts are shear bolts.

18. A assembly of claim 13, wherein the first and second bolts have a threaded portion.

19. A assembly of claim 18, wherein the first and second apertures have a threading that corresponds to the respective threaded portions of the first and second bolts.

20. The assembly of claim 13, wherein at least one of the first bolt and the second bolt includes an installation washer positioned therearound.

21. The assembly of claim 13, wherein each of the first bolt and the second bolt is positioned at an angle to the top surfaces of the wedge and the shell when each of the first bolt and the second bolt is positioned through the first aperture and first opening and through the second aperture and second opening, respectively.

22. The assembly of claim 21, wherein each of the first bolt and the second bolt is perpendicularly positioned to the top surfaces of the wedge and the shell when each of the first bolt and the second bolt is positioned through the first aperture and first opening and through the second aperture and second opening, respectively.

23. The assembly of claim 21, wherein each of the first bolt and the second bolt is configured to move the wedge toward the second end of the shell when the first bolt is inserted through the first aperture and into the first opening, and the second bolt is inserted through the second aperture and into the second opening.

24. The assembly of claim 13, wherein the wedge further comprises a first side surface having a first groove configured to receive a portion of a first conductor and hold the first conductor via friction fit within the first channel when the wedge is assembled with the shell.

* * * * *